US006123122A

United States Patent [19]

Dushman

[11] Patent Number: 6,123,122

[45] Date of Patent: Sep. 26, 2000

[54] HYGENIC BOTTLE CAP AND LIQUID DISPENSING SYSTEM

[75] Inventor: Lawrence M. Dushman, Peachtree City, Ga.

[73] Assignee: Abel Unlimited, Inc., West Palm Beach, Fla.

[21] Appl. No.: 09/267,103

[22] Filed: Mar. 12, 1999

Related U.S. Application Data

[60] Provisional application No. 60/104,893, Oct. 20, 1998.

[51] Int. Cl.[7] ..... B65B 1/04

[52] U.S. Cl. ..... 141/348; 141/330; 222/81

[58] Field of Search ..... 141/348, 329, 141/330; 222/81, 88, 90

[56] References Cited

U.S. PATENT DOCUMENTS

| | | |
|---|---|---|
| D. 264,942 | 6/1982 | Schieser et al. . |
| D. 270,136 | 8/1983 | Cox . |
| D. 270,616 | 9/1983 | Cox . |
| D. 272,604 | 2/1984 | Cox . |
| D. 276,592 | 12/1984 | Cox . |
| D. 326,051 | 5/1992 | Frahm . |
| D. 326,608 | 6/1992 | Frahm . |
| D. 339,067 | 9/1993 | Rokus . |
| D. 355,367 | 2/1995 | Rokus . |
| D. 361,039 | 8/1995 | Rokus . |
| D. 361,720 | 8/1995 | Rokus et al. . |
| 1,142,210 | 6/1915 | Wagner . |
| 1,248,705 | 12/1917 | Pogue . |
| 2,213,465 | 9/1940 | Gay . |
| 3,392,860 | 7/1968 | Faulstich . |
| 3,938,520 | 2/1976 | Scislowicz et al. . |
| 3,979,002 | 9/1976 | Faulstich . |
| 4,022,258 | 5/1977 | Steidley . |
| 4,093,096 | 6/1978 | Augros . |
| 4,143,789 | 3/1979 | Wade . |
| 4,173,858 | 11/1979 | Cassia . |
| 4,354,609 | 10/1982 | Hidding . |
| 4,364,483 | 12/1982 | Golde . |
| 4,393,909 | 7/1983 | Pearson . |
| 4,460,100 | 7/1984 | Libit . |
| 4,461,394 | 7/1984 | Sendel et al. . |
| 4,488,655 | 12/1984 | Itsubo et al. . |
| 4,527,704 | 7/1985 | Swartzbaugh . |
| 4,527,706 | 7/1985 | Swartzbaugh et al. . |
| 4,597,423 | 7/1986 | Chenot . |
| 4,658,977 | 4/1987 | Crisci . |
| 4,699,188 | 10/1987 | Baker et al. . |
| 4,717,051 | 1/1988 | Leclerc . |
| 4,736,859 | 4/1988 | Mayes et al. . |
| 4,846,236 | 7/1989 | Deruntz . |
| 4,874,023 | 10/1989 | Ulm . |
| 4,946,055 | 8/1990 | Towns et al. . |
| 4,948,003 | 8/1990 | Munoz . |
| 4,953,729 | 9/1990 | Kloosterhouse . |
| 4,991,635 | 2/1991 | Ulm . |
| 5,048,723 | 9/1991 | Seymour ..... 222/81 |
| 5,121,778 | 6/1992 | Baker et al. . |
| 5,123,555 | 6/1992 | Luch et al. . |
| 5,188,628 | 2/1993 | Rani et al. . |
| 5,202,093 | 4/1993 | Cloyd . |
| 5,203,838 | 4/1993 | Schneider . |
| 5,232,125 | 8/1993 | Adams . |
| 5,289,855 | 3/1994 | Baker et al. . |
| 5,295,519 | 3/1994 | Baker et al. . |
| 5,297,599 | 3/1994 | Bucheli . |
| 5,363,890 | 11/1994 | Yeung et al. . |
| 5,392,939 | 2/1995 | Hidding et al. . |
| 5,413,152 | 5/1995 | Burrows . |
| 5,456,294 | 10/1995 | Tsao et al. . |
| 5,472,021 | 12/1995 | Tsao et al. . |
| 5,573,047 | 11/1996 | Akin . |
| 5,653,270 | 8/1997 | Burrows . |
| 5,687,865 | 11/1997 | Adams et al. . |
| 5,687,867 | 11/1997 | Lamoureux . |
| 5,711,420 | 1/1998 | Spring . |
| 5,730,334 | 3/1998 | Mizrahi . |

FOREIGN PATENT DOCUMENTS

| | | |
|---|---|---|
| 0 118 267 B1 | 9/1984 | European Pat. Off. . |
| WO 90/03919 | 4/1990 | WIPO . |

*Primary Examiner*—Steven O. Douglas
*Attorney, Agent, or Firm*—Salter & Michaelson

[57] ABSTRACT

A hygienic bottle cap for connection to a neck of a fluid container includes a skirt and a crown portion which includes a cylindrical wall having an upper portion and a lower portion and forms a central well. A flapper forming a portion of the bottom surface of the center well is attached to the cylindrical wall via two separate tab points. A score line is formed partially around the perimeter of the flapper between the flapper and the cylindrical wall and the portion of the perimeter that is not scored remains intact upon insertion of a probe. Alternatively, the flapper may be attached to the cylindrical wall via a bridge portion. The flapper may be separated from the cylindrical wall by the probe and the flapper may return to its initial sealed position after the probe is retracted due to the memory characteristics of the material connecting the flapper to the cylindrical wall.

14 Claims, 11 Drawing Sheets

HYGENIC BOTTLE CAP AND LIQUID DISPENSING SYSTEM

CROSS-REFERENCE TO RELATED APPLICATION

This application claims priority from a U.S. Provisional patent application entitled "Hygienic Bottle Cap and Liquid Dispensing System," Ser. No. 60/104,893, filed on Oct. 20, 1998, which is hereby incorporated by reference.

FIELD OF THE INVENTION

The present invention is directed to a system for dispensing water and, more particularly, to a bottle cap for providing selective access to contained water upon loading of a bottle onto a dispensing system. Specifically, the present invention enables a water bottle to be mated to a water cooler without allowing dust or debris that has collected on the bottle to enter the water supply.

BACKGROUND OF THE INVENTION

A hygienic liquid dispensing system includes a container for the liquid (e.g., water) to be dispensed, wherein the container is generally a bottle having a neck surrounding an aperture. The bottle may be loaded into a dispenser by lifting and inverting the bottle and placing the neck into a receptacle in the dispenser, which is adapted to hold the bottle in the inverted position. The water can then be discharged through an aperture through a tube or other passageway formed in the receptacle and into a chamber in the dispenser. A user may then draw water from the chamber through a stop valve.

Dispensers for water often include a sharp probe which is used to puncture a cap on the water container when the container is placed in the dispenser. However, the sharpness of the probe can result in injuries when a hand or fingers of a person contact the sharp probe area during cleaning or positioning the water container. Other conventional bottle caps are removed when the dispenser does not include a probe and the bottle top is exposed when inverted, so that water tends to spill out of the bottle. Thus, there is a need for a hygienic bottle cap which reduces the amount of spillage that occurs and which does not require a large amount of force to pierce the cap so that a safer probe in the dispenser may be used.

SUMMARY OF THE INVENTION

In one embodiment, a hygienic bottle cap for connection to a fluid container has a skirt and a crown portion and includes a cylindrical wall having an upper portion and a lower portion and forming a central well in the crown portion of the cap. A flapper forming a portion of the bottom surface of the central well is attached to the cylindrical wall and a score line is formed partially around the perimeter of the flapper such that a probe may enter the central well and enter the container by pushing a portion of the flapper and separating a portion of the flapper from the cylindrical wall. The flapper may be connected to the cylindrical wall with two separate tab portions.

In another embodiment, the flapper may be attached to the cylindrical wall with a bridge connected to the flapper. The flapper may be constructed of a material to allow the flapper to return to its original sealed position after a probe which has separated the flapper has been removed from the central well. In another embodiment, the flapper may form the entire bottom surface of the central well such that a sealing shelf may be formed with the cylindrical wall.

BRIEF DESCRIPTION OF THE DRAWINGS

The above and further advantages of this invention may be better understood by referring to the following description when taken in conjunction with the accompanying drawings, in which.

DETAILED DESCRIPTION OF THE INVENTION

Figure 1:
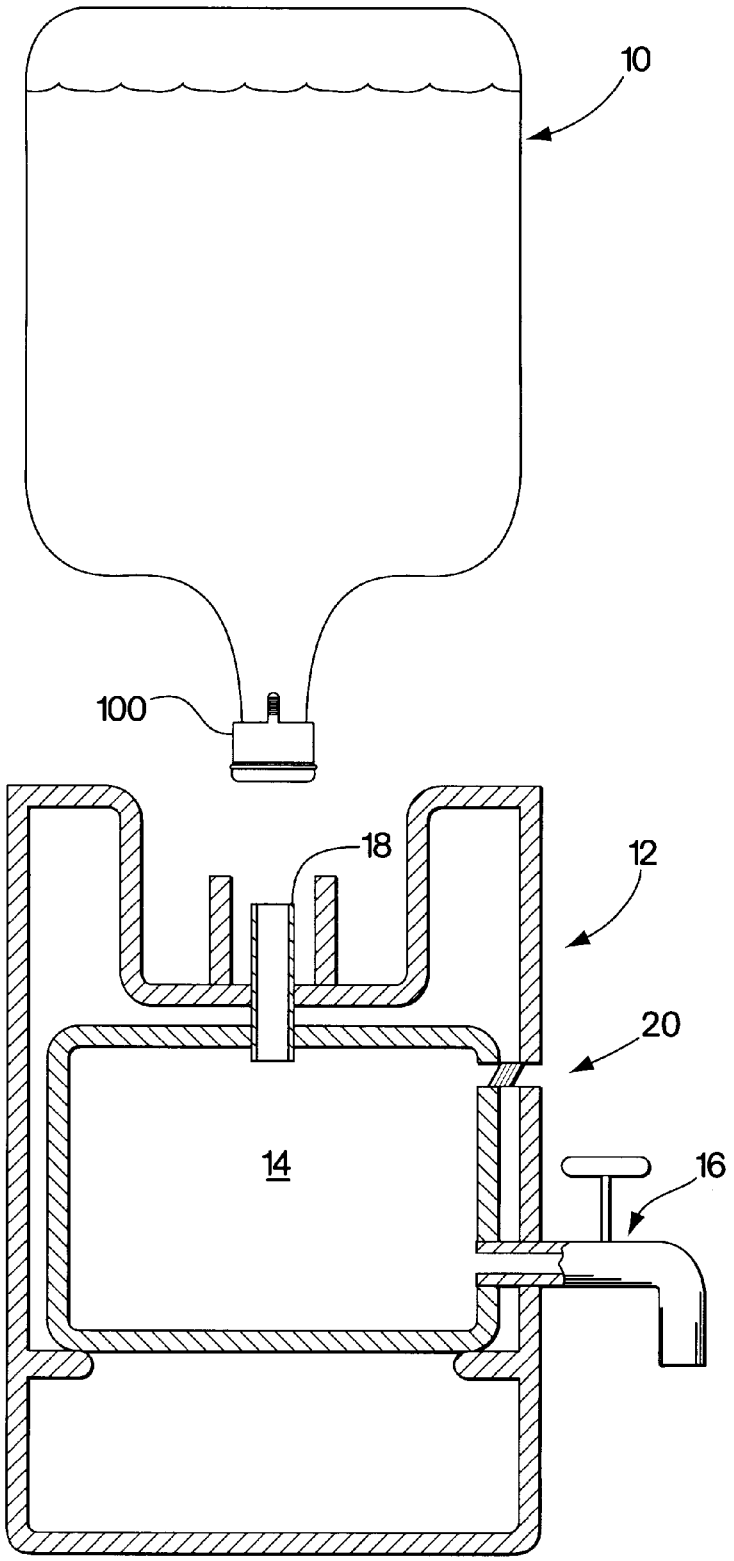
FIG. 1 is a cross-sectional view of an exemplary bottle and water dispenser for use with the bottle cap of the present invention.

This invention relates to a bottle cap for use with a standard five gallon water bottle or other similar fluid container. As is well known in the art, and as illustrated in FIG. 1, a water bottle 10 is sealed on one end by a cap 100. A water cooler 12 is designed to receive the water bottle 10 on an upper surface to enable the water within the water bottle to enter a chamber 14 prior to being dispensed through dispensing system 16. A probe 18 is provided to pierce the cap 100 to enable water to flow between the bottle 10 and the water cooler 12. Filtered air is provided to the chamber 14 through a filtered air system to enable water to be drawn off. One exemplary dispenser for use with the invention is disclosed in U.S. Pat. No. 4,699,188, entitled HYGIENIC LIQUID DISPENSING SYSTEM, the content of which is hereby incorporated by reference. An exemplary probe for use in connection with the present invention is disclosed in U.S. Pat. No. 5,232,125, entitled NON-SPILL BOTTLE CAP USED WITH WATER DISPENSERS, the content of which is hereby incorporated by reference.

Figure 2:
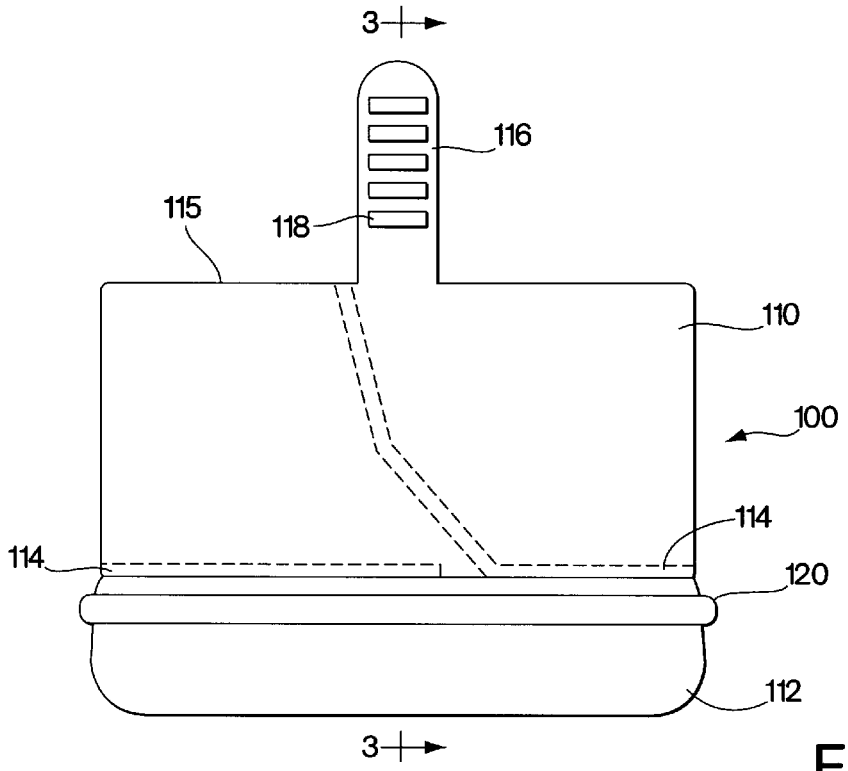
FIG. 2 is a side view of a bottle cap according to one embodiment of the present invention.

The cap 100, illustrated in more detail in FIG. 2, includes a skirt 110 and a crown 112. A score line 114 is formed between the skirt 110 and the crown 112 to enable the skirt 110 to be torn from the crown 112 as is well known in the art. The score line 114 also extends from the crown to a distal edge 115 of the skirt. A pull tab 116 with several grip lines 118 is attached to the skirt 110 at the distal edge 115 near the score line 114. By pulling on the pull tab 116, the user can cause the skirt 110 to tear along the score line 114 from the distal edge 115 of the skirt 110 to the crown 112 of the skirt 110 and then substantially around a perimeter of the crown 112. Removing the skirt 110 facilitates removing the cap from the bottle 10 for use with water coolers 12 that are not equipped with probes 18. A ridge 120 can be provided on the crown to enable the user to grasp the cap 100 more easily when lifting the bottle 10.

Figure 3:
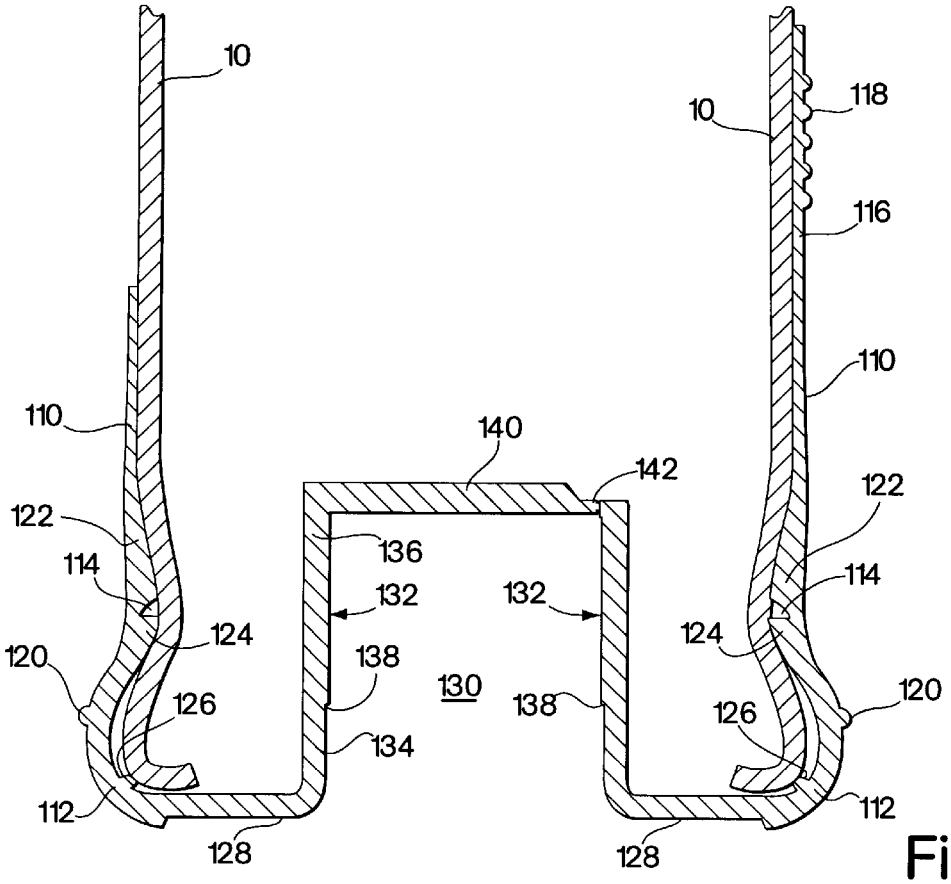
FIG. 3 is a cross-sectional view of the bottle cap of FIG. 2 taken along line I—I of FIG. 2 and along line II—II of FIGS. 4A, 4B.

The inside surface of the cap 100 is designed to form a seal with the neck of the bottle 10. Specifically, as shown in FIG. 3, the inside surface is provided with a thickened portion 122 to mate with an area of reduced circumference of the bottle 10 and to provide strength to the skirt near the score line. A second thickened portion 124 is provided on the crown 112 to mate with a sloped surface of the bottle 10. The second thickened portion 124 slips under a crown of the bottle 10 to pull the cap 100 onto the bottle 10. Also, the second thickened portion acts as a secondary seal between the cap 100 and the bottle 10 to prevent water from leaking out of the bottle 10. A point 126 is provided as a primary seal between the cap 100 and the top of the bottle 10. More than one point 126 may be used if desired. The point 126 may deform while seating the cap 100 on the bottle 10 to form a more secure seal.

As shown in FIG. 3, an annular indented region 128 can be formed on the outside surface of the cap 100 around a central well 130. The annular indented region is designed to receive an adhesive label (not shown) to maintain the central well 130 free of dust and other debris. Optionally, the label may be printed with identifying information to enable the source of the water to be identified readily. In one embodiment, the cap 100 may have a flush outside surface without the annular indented region 129 (see FIG. 10).

The central well 130 is formed from a cylindrical wall 132 having an upper portion 134 and a lower portion 136. Upper and lower in this context should be viewed from the perspective of the well—the top of the well is adjacent the annular indented region 128 and the bottom of the well is closed by a flapper 140 (discussed below). The upper portion 134 of the cylindrical wall 132 is configured such that its diameter is slightly larger than a diameter of the probe 18. The increased diameter of this upper portion 134 facilitates seating of the probe 18 into the central well 130 when the bottle 10 is placed on the dispenser 12. The lower portion 136 of the cylindrical wall 132 is designed to have a diameter equal to or marginally smaller than the diameter of the probe 18 to ensure a proper seal between the probe 18 and central well 130 of the cap 100.

The upper portion 134 and the lower portion 136 may be separated by a transition portion 138 formed perpendicular to the upper and lower portions respectively. Alternatively, the transition portion 138 may be set at an angle other than perpendicular to the upper and lower portions. Optionally, the upper and lower portions may be blended together so that the cylindrical wall 132 has a continuously varying diameter along at least a portion of its length. Likewise, if desired, the cylindrical wall 132 could be formed to have a continuous diameter approximately equal to the diameter of the probe 18 to form a seal along the entire surface of the cylindrical wall 132.

A flapper 140 forms the bottom surface of the central well 130. The flapper 140 is attached to the cylindrical wall 132 along the lower portion 136 of the cylindrical wall 132, and preferably at or near the bottom of the well 130. The flapper may be between 20 and 60 thousandths of an inch thick (20–60 mils), and preferably is about 20 mils thick.

A score line 142 is formed around the perimeter of the flapper 140, to enable the flapper 140 to be separated from the cylindrical wall 132 upon insertion of the probe 18. The score line 142 may be, in an axial direction of the cap, between 3 to 10 mils thick, preferably approximately 5 mils thick, and may be, in a radial direction of the cap 100, between 1 to 10 mils wide, preferably approximately 3 mils wide.

Figure 4A:
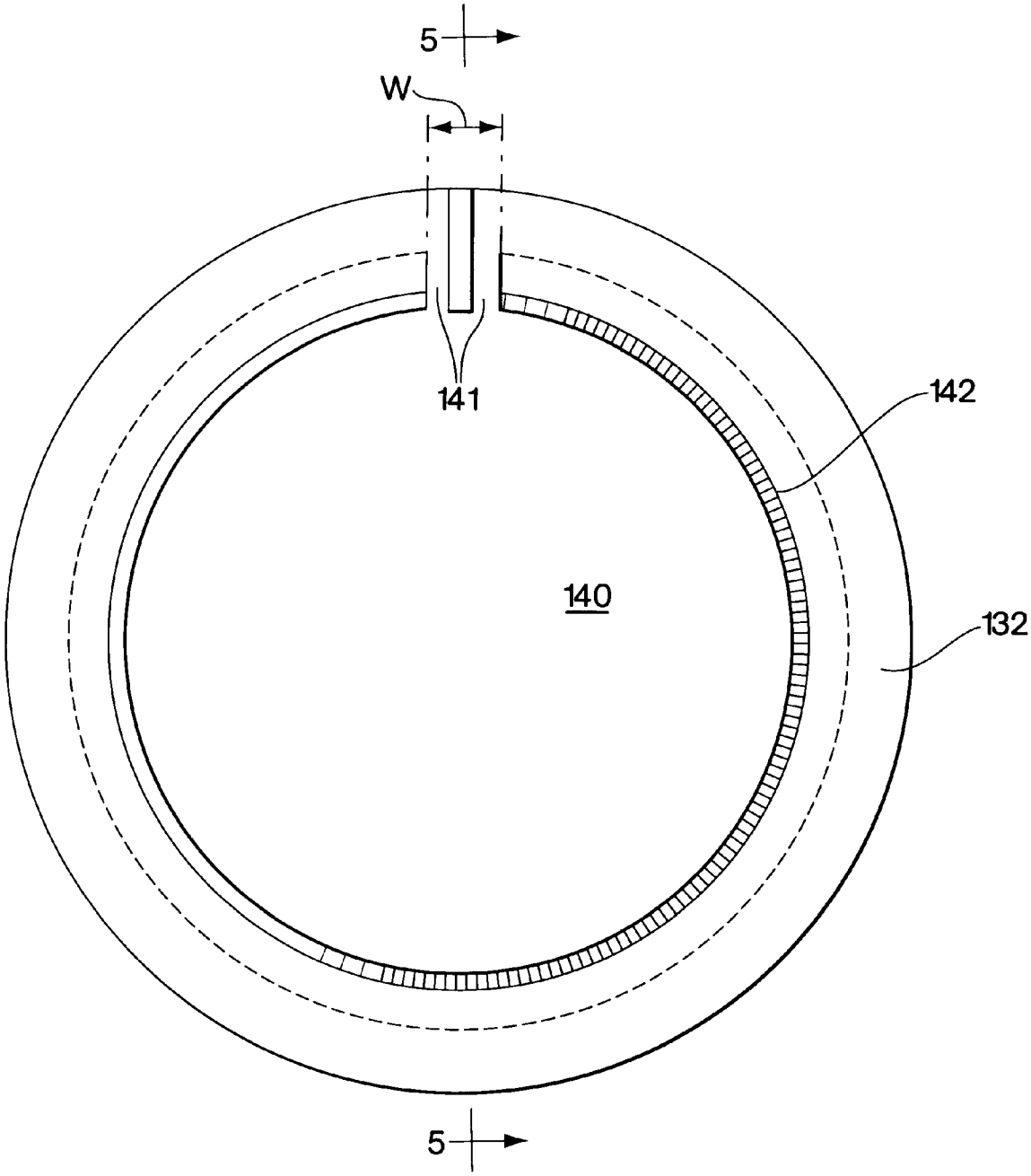
FIG. 4A is a top view in partial cross-section of the cylindrical sidewall and flapper of FIG. 2.

The score line 142 does not extend completely around the perimeter of the flapper 140. Instead, as shown in FIG. 4A, a portion of material relatively thicker than the material of the score line 142 is provided as two tab points 141 to connect the flapper 140 to the cylindrical wall 132 during and after insertion of probe 18 into central well 130.

Figure 4B:
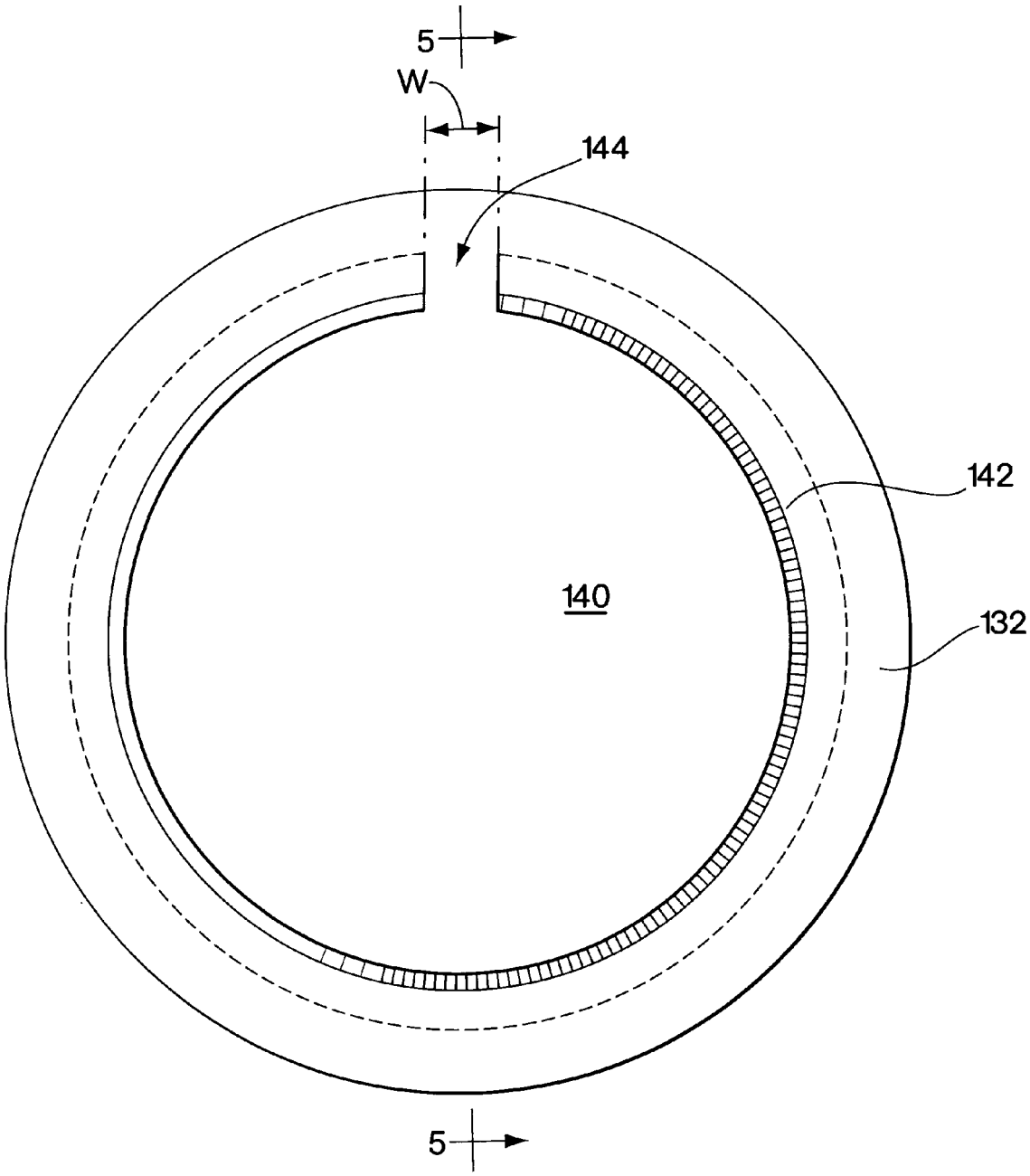
FIG. 4B is a top view in partial cross-section of the cylindrical sidewall and flapper of FIG. 2.

In another embodiment, shown in FIG. 4B, the connection between the flapper 140 and the cylindrical wall 132 may be formed by a single tab, by providing material in the space between tab points 141 to form a bridge 144. The bridge 144 may be between 30 and 180 mils wide, and is preferably approximately 180 mils wide (W). The two tab points 141 taken together, or the bridge 144 may be the same thickness, thicker or thinner than the flapper 140, although preferably the thickness is between about 20 to 60 mils thick. Both the tab points 141 and the bridge 144 should be of sufficient width and thickness to prevent the flapper 140 from separating from the cylindrical wall 132 upon insertion of the probe 18. In another embodiment, the bridge 144 or tab points 141 may incorporate a true to life hinge.

Figure 5:
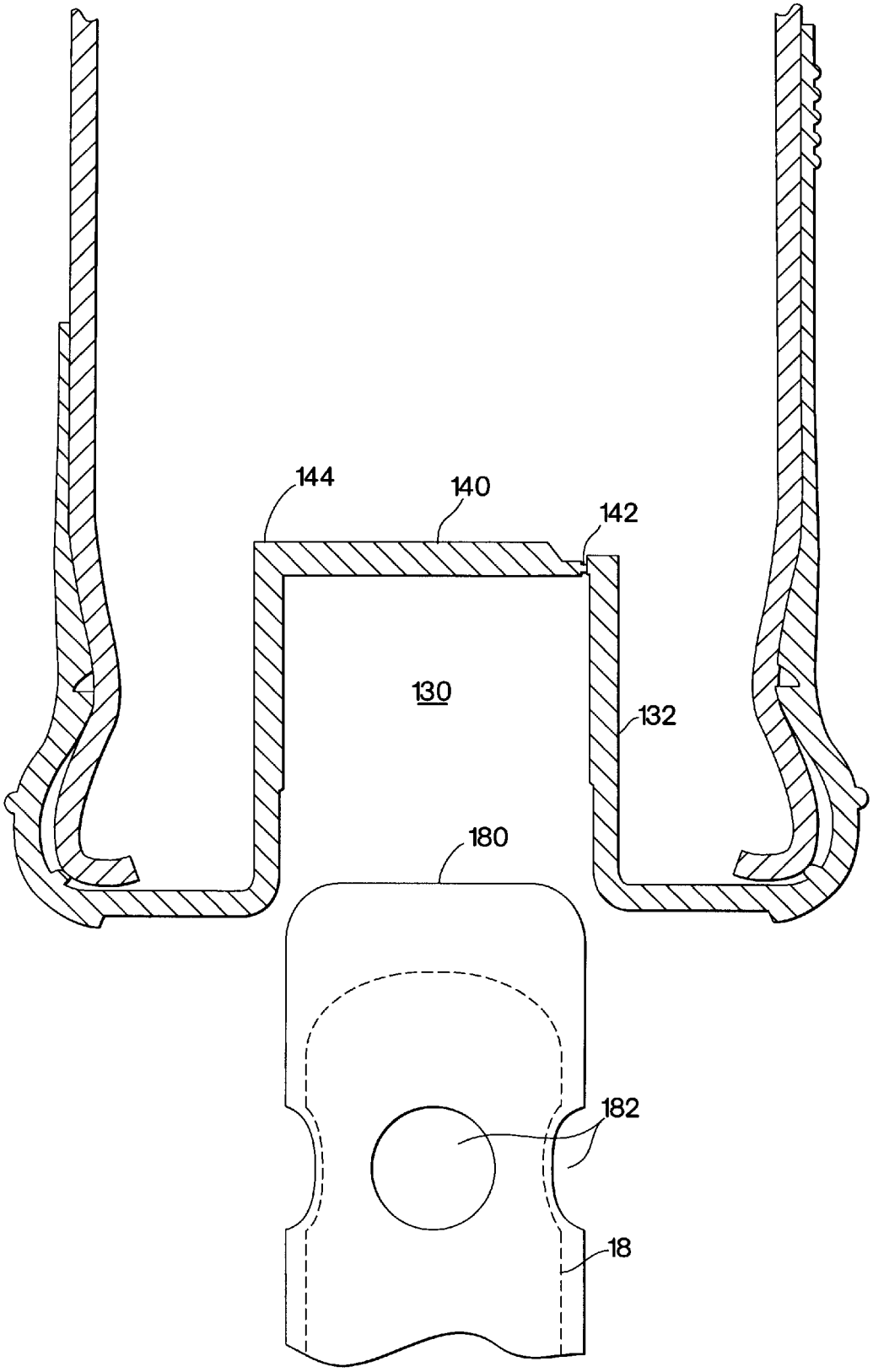
FIG. 5 is a cross-sectional view of the bottle cap of FIG. 2 taken along line I—I of FIG. 2 and along line II—II of FIGS. 4A, 4B prior to insertion of a probe.
Figure 6:
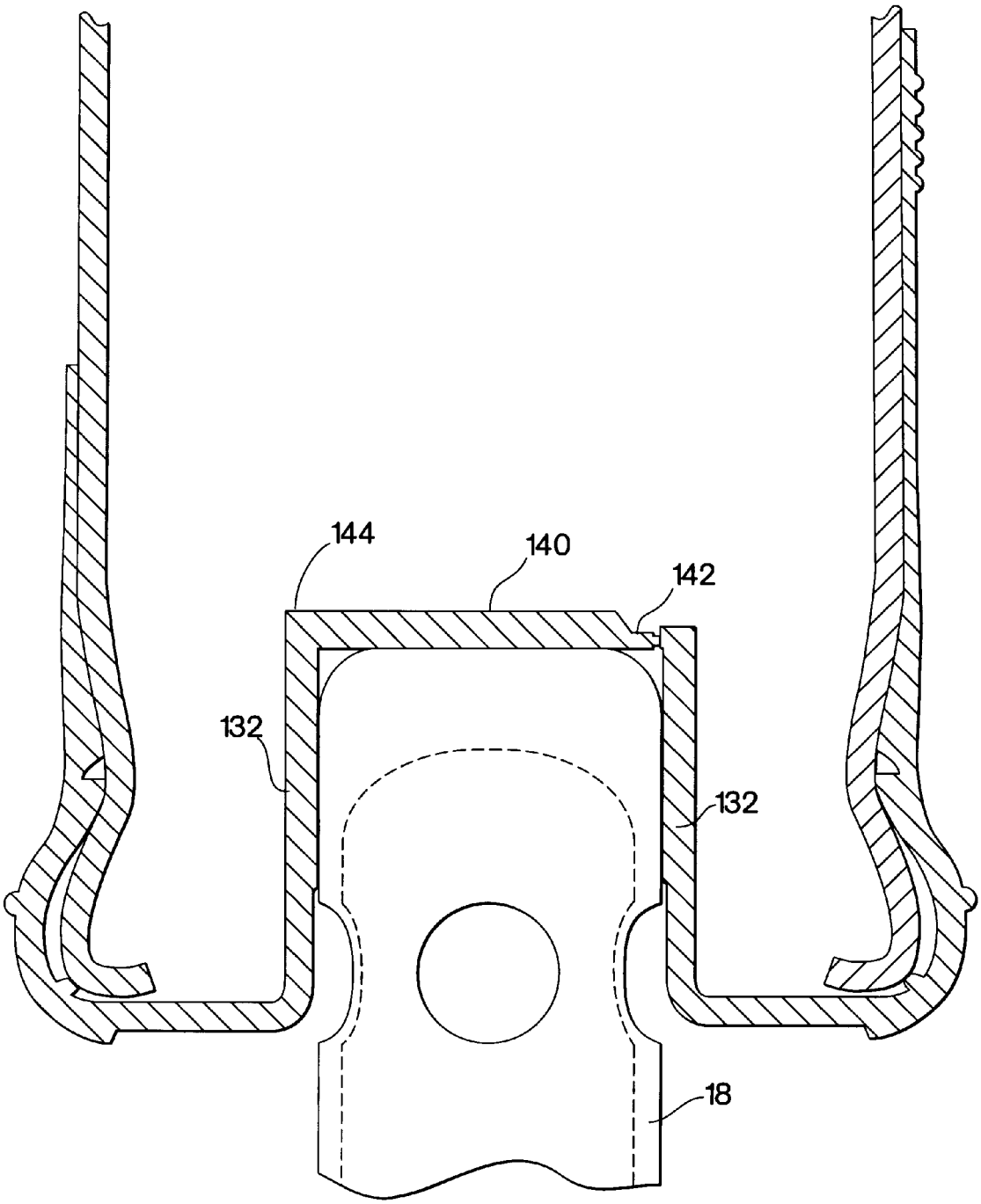
FIG. 6 is a cross-sectional view of the bottle cap of FIG. 2 taken along line I—I of FIG. 2 and along line II—II of FIGS. 4A, 4B subsequent to insertion of the probe, but before the probe tears the flapper from the cylindrical sidewall along the score line.
Figure 7:
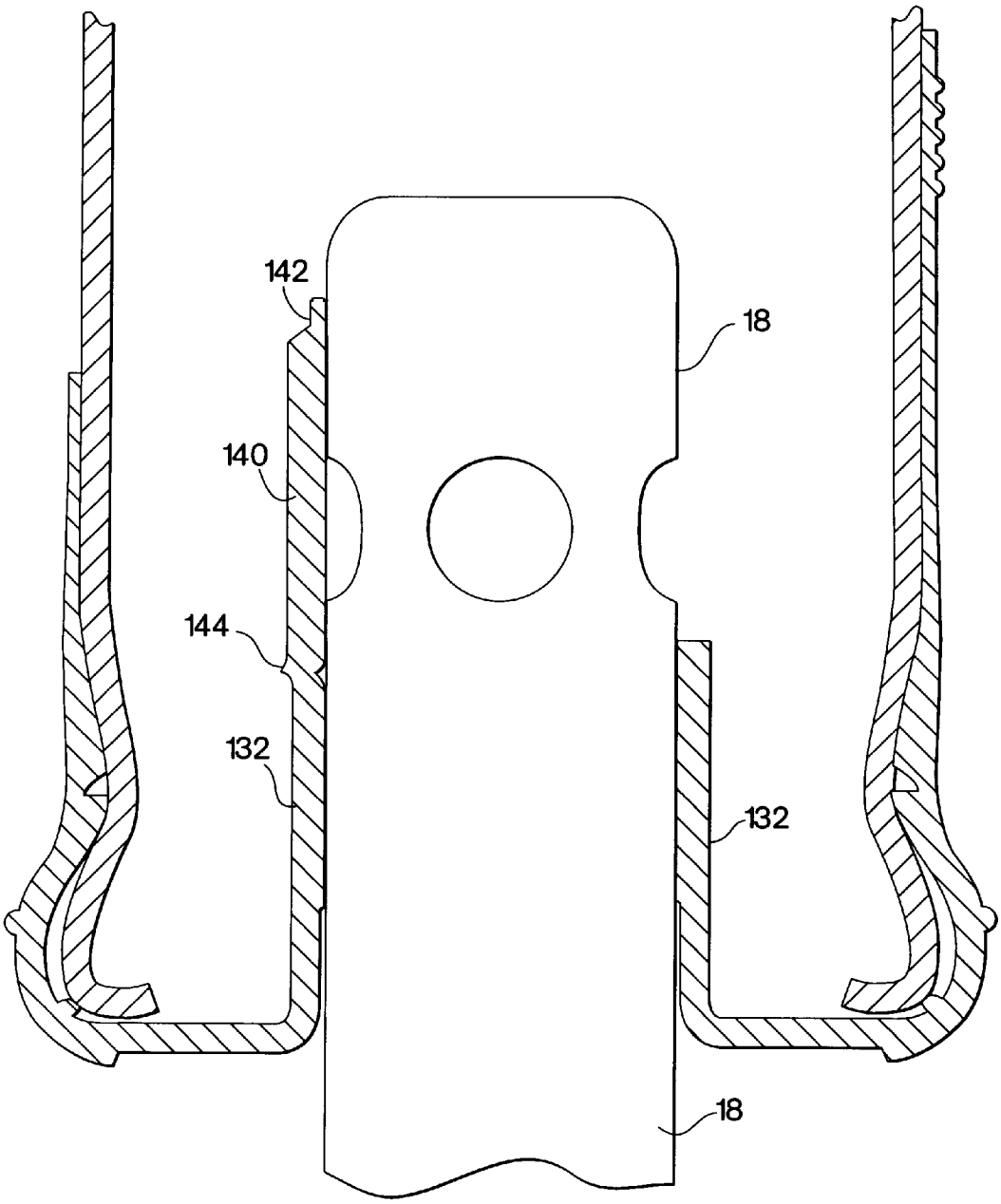
FIG. 7 is a cross-sectional view of the bottle cap of FIG. 2 taken along line I—I of FIG. 2 and along line II—II of FIGS. 4A, 4B after the flapper has been separated from the cylindrical sidewall along the score line.

FIGS. 5–7 illustrate changes that occur to the cap 100 upon insertion of probe 18 into central well 130. Typically, but not always, this occurs by lowering water bottle 10 with carrying cap 100 onto a water cooler 12 having a probe 18. However, for convenience in this application, the probe will be referred to as entering central well 130 and piercing cap 100.

As shown in FIG. 5, the probe 18 is formed from a hollow tube having a rounded top surface 180. The top surface may be closed to prevent debris from falling through probe 18 into chamber 14 of dispenser 12 when a water bottle 10 is not in place on the cooler 12. In this situation, at least one and preferably more than one aperture 182 is formed through the wall of the hollow tube forming probe 18 so that upon insertion of the probe 18 into the water bottle 10, water may flow through the aperture 182, down through the probe 18 and into the water dispenser 12.

The probe 18 is inserted into the central well 130 until the top surface 180 comes into contact with the flapper 140. (see FIG. 6). At that point in time, the weight of the water will cause the water bottle to press down on the cap 100 to cause the probe 18 to push through the flapper 140 and separate the flapper 140 from the cylindrical wall 132 along the score line 142 (see FIG. 7). The bridge 144 is not severed in this process so that the flapper 140 remains attached via the bridge 144 to the cylindrical wall 132 defining the central well 130. Tab points 141 shown in FIGS. 4A and 10 may be used instead of the bridge 144, and both tab points 141 remain attached to the cylindrical wall 132 when the probe is inserted. The side views of bridge 144 and tab points 141 are substantially the same and therefore the side views of tab points 141 are not shown separately herein. A seal is formed between the probe 18 and the cylindrical wall 132 as discussed above.

Figure 9:
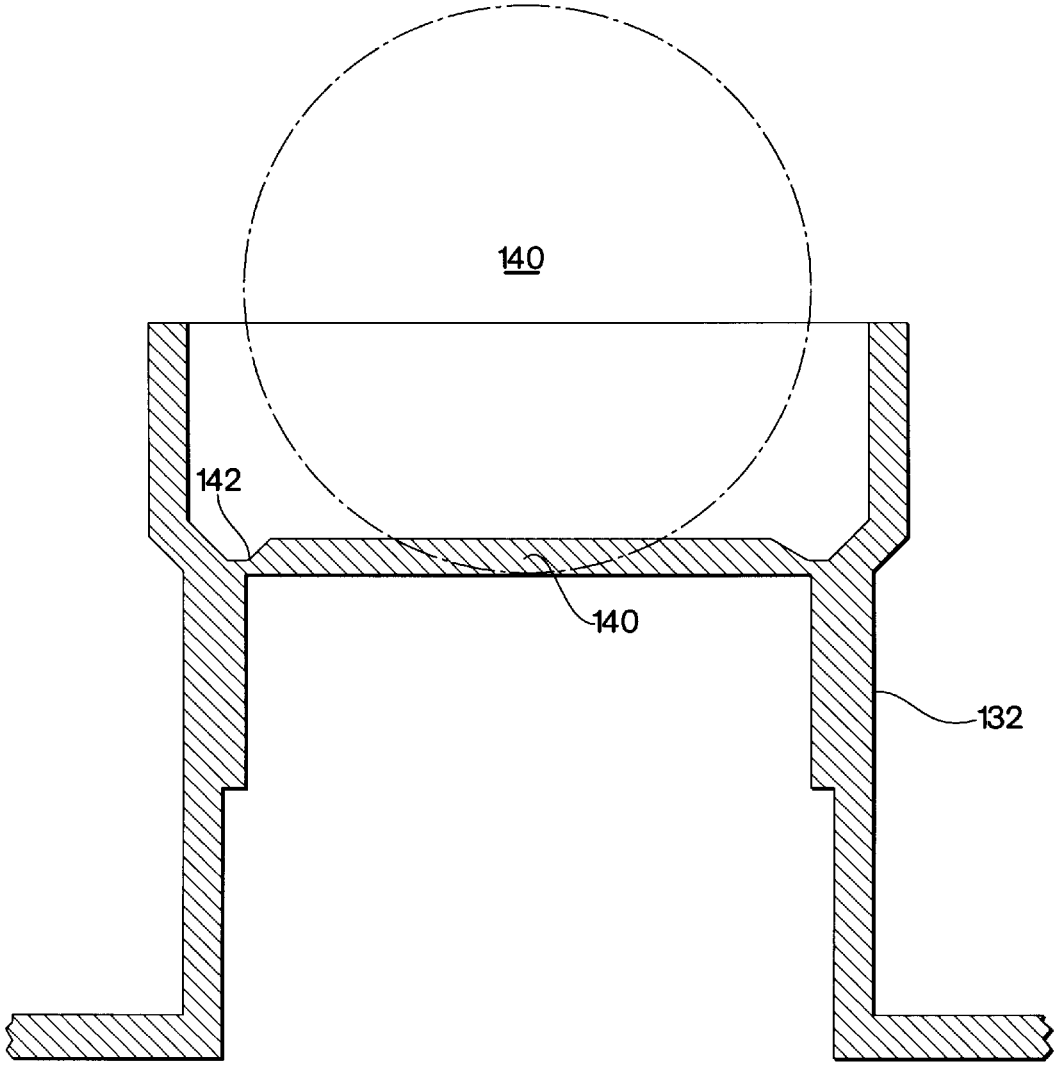
FIG. 9 is a cross-sectional view of the bottle cap of FIG. 2 illustrating the flapper in the closed position and in the open position (dashed lines)

FIG. 9 illustrates the flapper 140 in both the initial position, before insertion of the probe 18, and after the flapper 140 has been separated from the cylindrical wall 132 along the score line 142. The dashed circle represents the flapper 140 after separation from the cylindrical wall 132. In this Figure, the bridge 144 is formed on the edge of the cylindrical wall 132 closest to the viewer. In one embodiment, instead of moving vertically, the flapper 140 may slide to the side of the probe 18 during the insertion of the probe 18.

Figure 8:
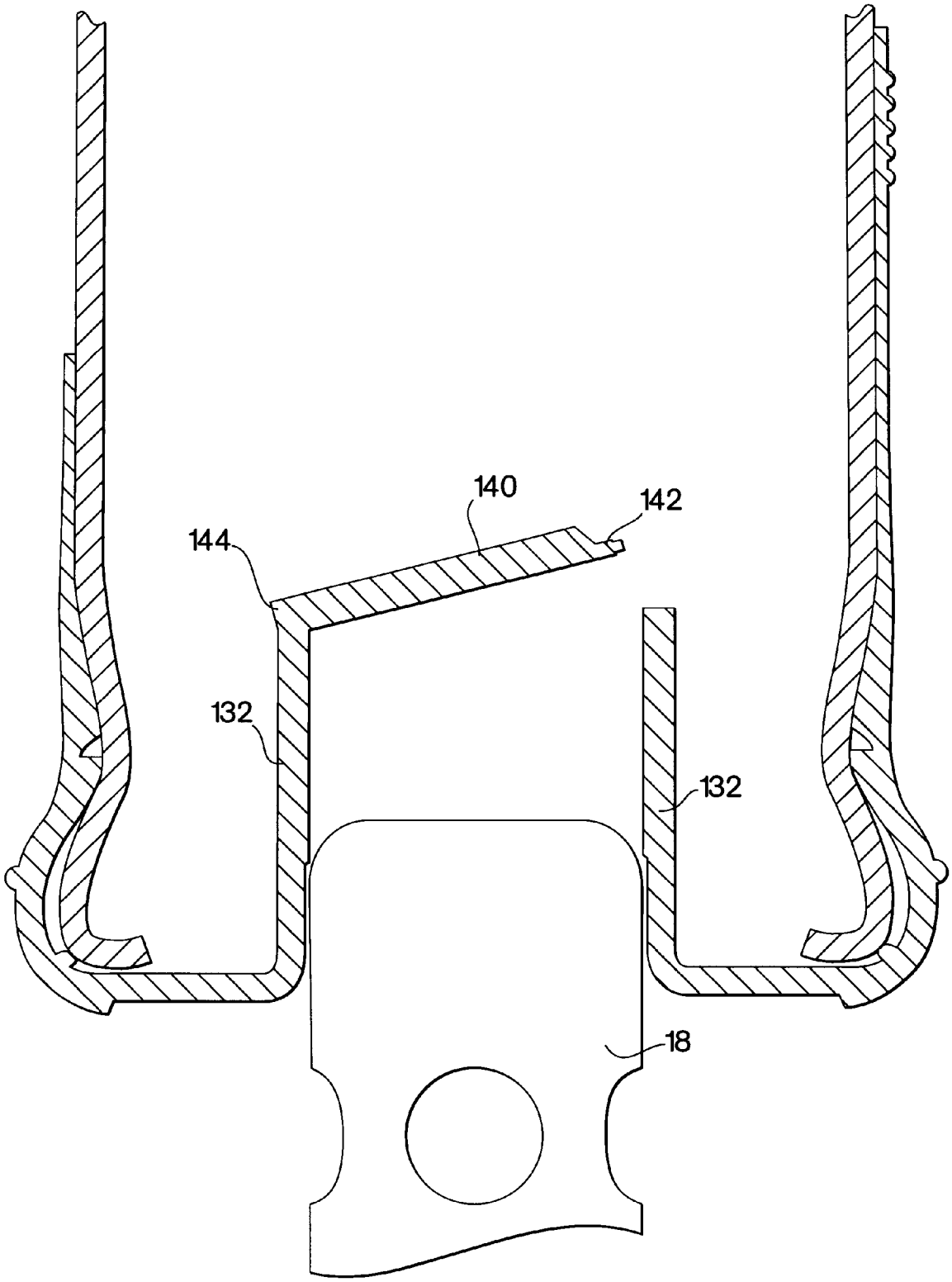
FIG. 8 is a cross-sectional view of the bottle cap of FIG. 2 taken along line I—I of FIG. 2 and along line II—II of FIGS. 4A, 4B after the probe has been partially withdrawn from the bottle cap.

When the probe 18 is retracted, as illustrated in FIG. 8, the bridge 144 causes the flapper to return toward its initial sealed position. Tab points 141 (FIGS. 4A, 10) have a similar effect on the flapper 140 when the probe 18 is retracted. The bridge 144 (and tab points 141) thus exhibits at least some shape memory tending to return the flapper toward its initial position. By returning the flapper 140 toward its initial sealed position, it is possible to minimize the amount of water that is spilled when the water bottle 10 is removed from the water cooler 12.

Figure 10:
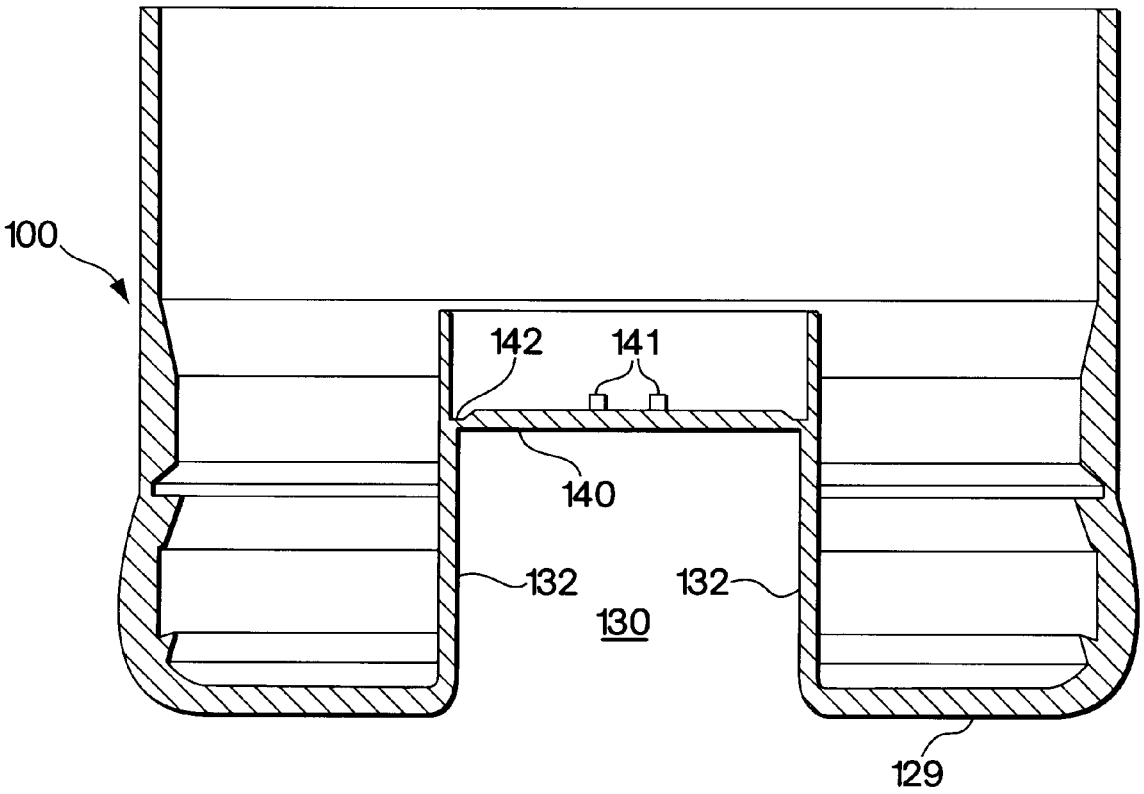
FIG. 10 is a cross-sectional view of a bottle cap similar to FIG. 2.

FIG. 10 illustrates the flapper 140 before insertion of the probe (not shown). In this Figure, the tab points 141 are formed on the edge of the cylindrical wall 132 closest to the viewer. The two tab points 141 allow the flapper 140 to close more easily when the probe is retracted. FIG. 10 also illustrates a cap 100 without a ridge 120 and with a flush surface, without annular indented region 128. FIG. 10 shows the cap 100 with cylindrical wall 132 extending beyond flapper 140. However, in one embodiment, it is possible to have flapper 140 connected to cylindrical wall 132 by two tab points 141, with the cylindrical wall 132 ending at the level of the flapper 140, similar to the wall 132 shown in FIG. 3.

In another embodiment, the bridge 144 may incorporate a spring mechanism to force the closure of the flapper valve and to reduce the amount of water which is spilled when the water bottle 10 is removed form the water cooler 12. In one embodiment, tab points 141 may also incorporate a spring mechanism. To further reduce the amount of spilled water, the flapper 140 may have a diameter which is the same as or larger than the central well 130 diameter. The larger sized diameter of the flapper 140 allows a sealing shelf between the flapper 140 and the cylindrical wall 132 and prevents the flapper 140 from being pushed through the sealing area by the force of the water on the flapper 140.

In one embodiment, a secondary material may be used during the molding process to provide the flapper 140 with more memory characteristics to allow quicker sealing when the probe 18 is retracted from the central well 130. The secondary material may be for example, a rubber or flexible thermoplastic. The secondary material may allow the thickness of flapper 140 to be thinner than 20 mils to allow the flapper 140 to close more easily. An antimicrobial compound may be added to the materials for molding the cap and/or the flapper to prevent bacteria growth on the cap surfaces.

Figure 11:
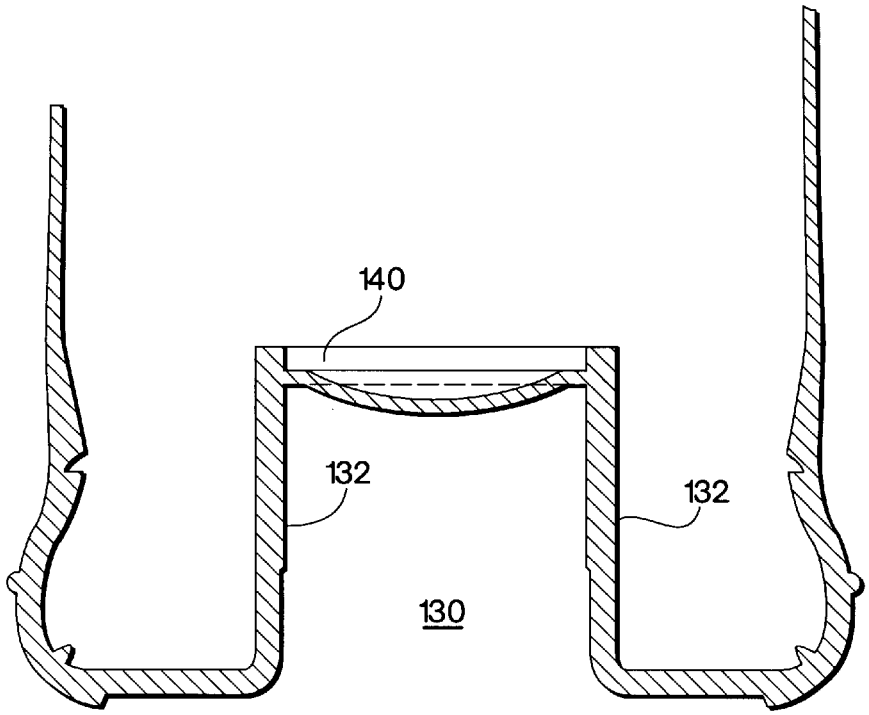
FIG. 11 is a cross-sectional view illustrating an alternative embodiment of the bottle cap according to the present invention.
Figure 12:
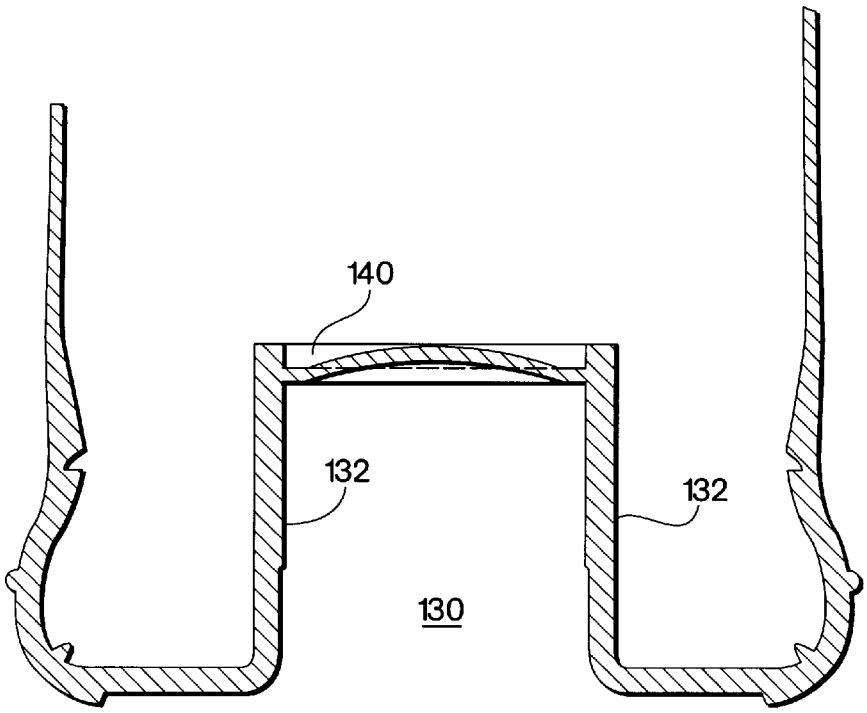
FIG. 12 is a cross-sectional view illustrating another alternative embodiment of the bottle cap according to the present invention.

Alternative embodiments are illustrated in FIGS. 9, 10, 11, and 12. As shown in FIGS. 9 and 10 the flapper 140 may be joined to the cylindrical sidewall 132 at a location other than at the lowest part of the cylindrical sidewall 132. As shown in FIGS. 11 and 12, the flapper 140 may be curved inward (FIG. 11) or bowed outward (FIG. 12). In any of the above embodiments, the cylindrical wall 132 may extend beyond the flapper 140 which may reduce the amount of water spilled when the bottle 10 is removed from the water cooler 12. In one embodiment, the cylindrical wall 132 may be extended 200 mils above the flapper 140.

Having thus described several particular embodiments of the invention, there is alternations, modifications and improvements that will readily occur to those skilled in the art. Such alternations, modifications, and improvements as are made obvious by this disclosure are intended to be part of this disclosure, though not expressly stated herein, and are intended to be within the spirit and scope of the invention. Accordingly, the foregoing description is by way of example only and is not intended to be limiting. The invention is limited only as defined in the following claims and equivalence thereto.

What is claimed is:

1. A hygienic bottle cap having a skirt and a crown portion for connection to a neck of a fluid container, the cap comprising;

a cylindrical wall having an upper portion and a lower portion and forming a central well in the crown portion;

a flapper forming a portion of the bottom surface of the central well and attached to the cylindrical wall; and a pre-formed score line disposed partially around the perimeter of the flapper, wherein upon a probe contacting the flapper, the probe separates a portion of the flapper from the cylindrical wall along the pre-formed score line in order to enter the container.

2. The hygienic bottle cap of claim 1, wherein the flapper is attached to the cylindrical wall with a hinge.

3. The hygienic bottle cap of claim 1, wherein the flapper is attached to the cylindrical wall with a bridge.

4. The hygienic bottle cap of claim 1, wherein the flapper is attached to the cylindrical wall with two separate tab points.

5. The hygienic bottle cap of claim 1, wherein the flapper substantially returns to an initial sealed position after the probe is retracted from the container.

6. The hygienic bottle cap of claim 1, wherein the flapper is constructed of rubber.

7. The hygienic bottle cap of claim 1, wherein the flapper is constructed of flexible thermoplastic.

8. The hygienic bottle cap of claim 1, wherein the thickness of the flapper is less than 20 mils.

9. The hygienic bottle cap of claim 1, wherein the cylindrical wall extends beyond the flapper.

10. The hygienic bottle cap of claim 1, wherein the flapper forms the entire bottom surface of the central well, such that the flapper forms a sealing shelf with the cylindrical wall.

11. The hygienic bottle cap of claim 1, wherein the surface of the cap includes an anti-microbial compound.

12. The hygienic bottle cap of claim 1, wherein the flapper is moved to a side of the probe which is inserted into the fluid container by pushing the flapper to separate the flapper from the cylindrical wall.

13. The hygienic bottle cap of claim 1, wherein the probe is a hollow tube having a rounded top surface.

14. A liquid dispensing system, including a fluid container comprising:

a hygienic bottle cap constructed and arranged to fit on the container, the cap having a central well, and a flapper formed on a portion of a bottom of the central well, the flapper being attached to a cylindrical wall forming the central well and being defined by a pre-formed score line disposed partially around the perimeter of the flapper;

a probe connected to the liquid dispensing system, wherein as the probe contacts the flapper in the bottle cap the probe separates the flapper from a portion of the cylindrical wall along the pre-formed score line so as to allow liquid to flow from the container to a valve in the liquid dispensing system.

* * * * *

UNITED STATES PATENT AND TRADEMARK OFFICE
CERTIFICATE OF CORRECTION

PATENT NO : 6,123,122

DATED : September 26, 2000

INVENTOR(S) : Lawrence M. Dushman

It is certified that error appears in the above-identified patent and that said Letters Patent are hereby corrected as shown below:

Col. 2, line 13
replace "line I-I" with --line 3-3--
replace "line II-II" with --line 5-5--.

Col. 2, line 21
replace "line I-I" with --line 3-3--
replace "line II-II" with --line 5-5--.

Col. 2, line 24
replace "line I-I" with --line 3-3--
replace "line II-II" with --line 5-5--.

Col. 2, line 29
replace "line I-I" with --line 3-3--
replace "line II-II" with --line 5-5--.

Col. 2, line 33
replace "line I-I" with --line 3-3--
replace "line II-II" with --line 5-5--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*